US006833817B2

(12) United States Patent
Olsen

(10) Patent No.: US 6,833,817 B2
(45) Date of Patent: Dec. 21, 2004

(54) METHOD AND COLLAPSIBLE ANTENNA FOR WIRELESS COMMUNICATION

(75) Inventor: Christopher N. Olsen, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 74 days.

(21) Appl. No.: 10/322,146

(22) Filed: Dec. 17, 2002

(65) Prior Publication Data

US 2004/0113850 A1 Jun. 17, 2004

(51) Int. Cl.[7] ..... H01Q 1/24
(52) U.S. Cl. ..... 343/702; 343/700 MS; 343/795
(58) Field of Search ..... 343/702, 700 MS, 343/795, 793; H01Q 1/24

(56) References Cited

U.S. PATENT DOCUMENTS 6,518,927 B2 * 2/2003 Schremmer et al. ..... 343/702

6,518,929 B1 * 2/2003 Gilmore ..... 343/725

* cited by examiner

*Primary Examiner*—Hoanganh Le
(74) *Attorney, Agent, or Firm*—Schwegman, Lundberg, Woessner & Kluth, P.A.

(57) ABSTRACT

One or more dipole antennas are provided for wireless communications external to a conductive chassis of a communication device. The antenna, which may be initially in a folded position, may be inserted through a hole in the conductive chassis from an inside. An axial element may be retracted to expand a non-conductive structural element of the antenna on an outside side of the chassis. The non-conductive element has conductors disposed thereon to form the one or more dipoles. The axial element may be locked to prevent the antenna from retracting. The antenna may receive and transmit communications in more than one frequency range.

30 Claims, 6 Drawing Sheets

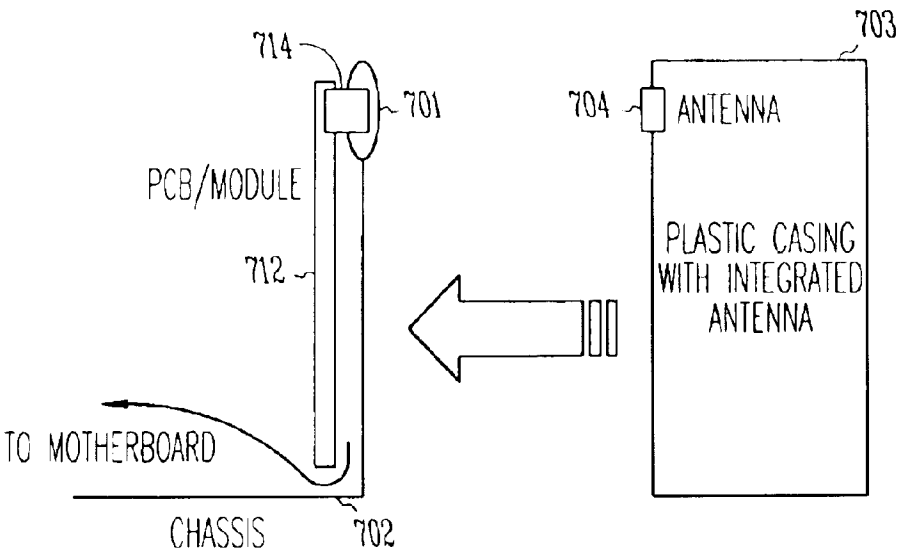
Fig. 7C
Fig. 7B
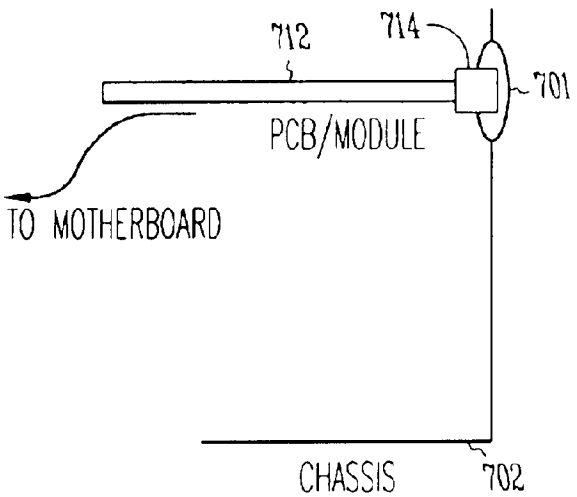
Fig. 7A

METHOD AND COLLAPSIBLE ANTENNA FOR WIRELESS COMMUNICATION

TECHNICAL FIELD

The present invention pertains to wireless communications, and in particular to antennas for wireless communication devices.

BACKGROUND

Processing and computing devices require an antenna and RF circuitry for wireless communications. Conventional techniques may have a user couple an antenna directly to a peripheral component interconnect (PCI) extension, which may be on the back of the device. Alternatively, an antenna may be adhesively coupled to a front panel of the device with cabling to the PCI extension. In situations where devices are already configured for RF communications, an additional antenna and RF circuitry may be required for RF communications in accordance with specific communication standards, such as the IEEE 802.11(a), 802.11(b) and/or 802.11(g) (ANSI/IEEE 802.11, 1999 edition, and as subsequently amended) standards for wireless local area network standards.

One problem with these conventional techniques is that the performance of RF communications, such as signal to noise ratio, bandwidth, and noise figure, may be degraded due to the RF cabling between the antenna and device. Another problem with conventional techniques is that multiple and/or complex connectors are required which sometimes require large holes in the chassis. Further, FCC rules require an integral connection for some intentional radiators, which creates a conflict between service and installation needs. Interconnect topologies also restrict location options and prevent customer-friendly solutions.

Thus there is a general need for an improved antenna suitable for wireless communications.

BRIEF DESCRIPTION OF THE DRAWINGS

The appended claims are directed to some of the various embodiments of the present invention. However, the detailed description presents a more complete understanding of embodiments of the present invention when considered in connection with the figures, wherein like reference numbers refer to similar items throughout the figures and:

FIGS. 7A, 7B and 7C illustrate the installation of a collapsible antenna in accordance with another embodiment of the present invention.

DETAILED DESCRIPTION

The following description and the drawings illustrate specific embodiments of the invention sufficiently to enable those skilled in the art to practice it. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the full ambit of the claims and all available equivalents.

Figure 1:
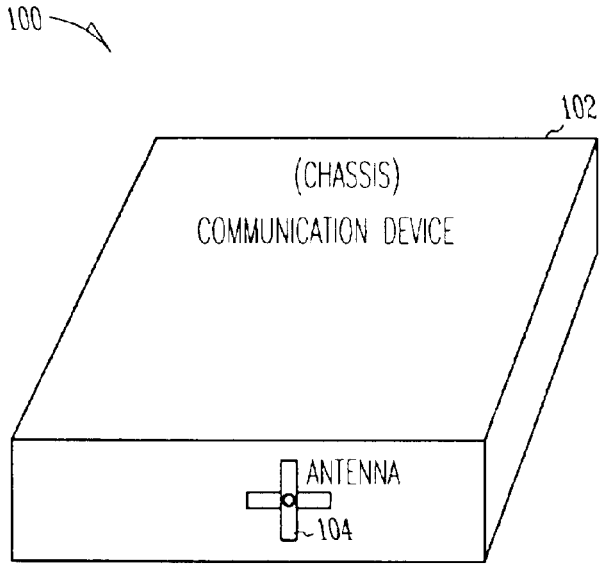
FIG. 1 illustrates a communication device with a collapsible antenna in accordance with an embodiment of the present invention.

FIG. 1 illustrates a communication device with a collapsible antenna in accordance with an embodiment of the present invention. Communication device 100 may be any form of processing, computing or communication device including, for example, a mobile data terminal, a wireless or cellular telecommunication device, or a personal computer. In other examples, device 100 may include hardware/software to operate as a personal digital assistant (PDA), a Web tablet, or any device that provides access to a communication or data network such as an intranet or the Internet.

In some embodiments, device 100 may include hardware and software for communicating over wireless links and implementing at least one of many communication techniques. Communication techniques that device 100 may implement may include digital and analog wireless communication techniques including code division multiple access (CDMA) techniques, wideband CDMA (WCDMA) techniques, or frequency division multiple access (FDMA) techniques, and/or time-division multiple access (TDMA) techniques. In some embodiments, device 100 may communicate in accordance with various communication standards and protocols including, for example, a wireless application protocol (WAP), or i-Mode protocol. Other examples of communication techniques that wireless communication device 100 may generally support include the many digital mobile communication standards, such as the Pan-European mobile system standard referred to as the Global System for Mobile Communications (GSM), and techniques in accordance with packet radio services such as the General Packet Radio Service (GPRS) packet data communication service. In one embodiment of the present invention, device 100 may provide communications in accordance with the Universal Mobile Telephone System (UMTS) for the next generation of GSM, which may, for example, implement the International Mobile Telecommunications for the year 2000 (IMT-2000) family of third-generation (3G) wireless standards. In this embodiment, one or more of external communication networks may provide packet data services (PDS) utilizing packet data protocols (PDP). In other embodiments, device 100 may communicate using a multi-carrier transmission technique, such as an orthogonal frequency division multiplexing (OFDM) technique that uses orthogonal subcarriers to transmit information within an assigned spectrum. Device 100 may also implement one or more communication standards for wireless local area network (WLAN) communications, including, for example one or more of the IEEE 802.11a, b or g standards, Bluetooth, the Digital Video Broadcasting Terrestrial (DVB-T) broadcasting standard, iterations of proposed ultra wideband (UWB) standards, and/or the High performance radio Local Area Network (HiperLAN) standard.

In accordance with embodiments of the present invention, antenna 104 may be almost any type of antenna for communicating in accordance with one or more of the communication techniques implemented by system 100. In one embodiment, antenna 104 may be comprised of one or more dipole antennas, which may be provided for WLAN communications external to chassis 102. Antenna 104 may initially be in a folded position, and may be inserted through a hole in the conductive chassis from the inside. In one embodiment, an axial element (not illustrated) may be retracted to expand a non-conductive element of the antenna on an outside side of the chassis. The non-conductive element may have conductors disposed thereon to form the one or more dipoles. The axial element may be locked to inhibit the antenna from retracting. Embodiments suitable for use as antenna 104 are described in more detail below. In addition to providing one or more dipole antennas, the conductive elements of antenna 104 may be arranged provide one or more monopoles, patch antennas, spiral antennas, meander-line antennas, a phased array antenna, and combinations thereof.

Figure 2:
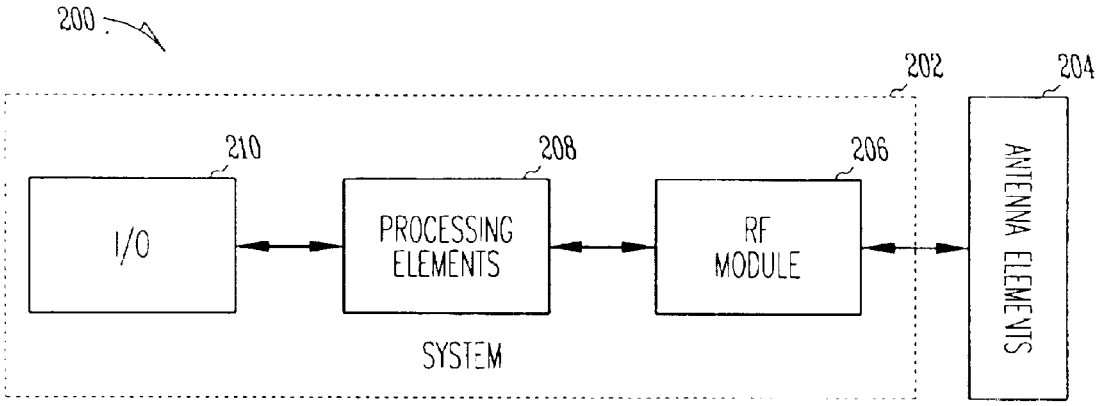
FIG. 2 is a system functional block diagram of a communication device in accordance with an embodiment of the present invention.

FIG. 2 is a system functional block diagram of a communication device in accordance with an embodiment of the present invention. Communication device 200 may be suitable for use as device 100 (FIG. 1) although other devices may also be suitable. Communication device 200 may include antenna elements 204, RF module 206, processing elements 208 and I/O elements 210. When the antenna is in a final position, RF module 206, processing elements 208 and I/O elements 210 may be located within chassis 202 and at least some of antenna elements 204 may be located external to chassis 202. RF module 206 converts digital signals to an analog form suitable for transmission by antenna elements 204 and converts analog signals received by antenna elements 204 to a digital form. Antenna elements 204 may be part of a collapsible antenna described in more detail below. In one embodiment, chassis 202 may be conductive and may provide a ground plane for the antenna in the final position. In alternative embodiments, the chassis may be non-conductive (e.g., plastic) and the antenna may be provided internal to the chassis. The antenna may be comprised of conductive elements and a non-conductive element. The conductive elements may form one or more dipole antennas, and the non-conductive element may be approximately flat in the final position, which may be planar and parallel to a side of the chassis.

In one embodiment, RF module 206 may include a packet radio interface, such as a GSM/GPRS interface or communicating with packet radio communication systems such as a GSM system with GPRS. RF module 206 may also include a digital mobile radio interface such as a WCDMA radio interface. In one embodiment, RF module 206 may include a wireless local area network (WLAN) interface for communicating in accordance with standards such as IEEE 802.11(a), 802.11(b) and/or 802.11(g). RF module 206 may also include a short-range wireless interface for communicating with PC's, mobile phones and other portable devices in accordance with a short-range digital communication protocol such as Bluetooth. RF module 206 may also include an ultra-wideband (UWB) interface. Antenna elements 204 may be selected to communicate in accordance with a particular communication technique. In one embodiment, RF module 206 may combine up to four or more data channels received from processing elements 208 for modulation onto a single carrier frequency. Alternatively, RF module 206 may combine up to four or more data channels received from processing elements 208 for modulation onto more than one carrier frequency for transmission by different antenna elements. In these embodiments, RF module 206 may separate the various data channels from received signals and provide separated data signals to processing elements 208. Although device 200 is illustrated as having several separate functional elements, one or more of the functional elements may be combined and may be implemented by combinations of software configured elements, such as processors including digital signal processors (DSPs), and/or other hardware elements.

Figure 3A:
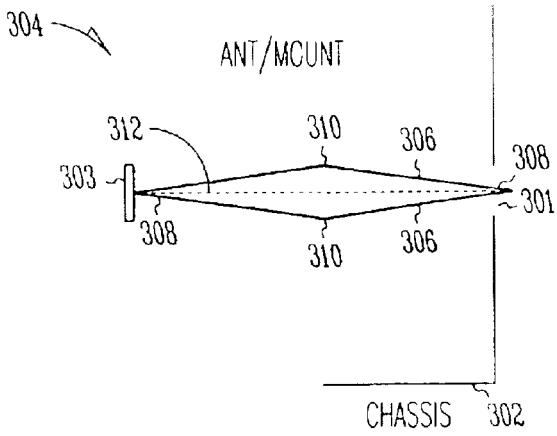
FIGS. 3A, 3B and 3C illustrate the installation of a collapsible antenna in accordance with an embodiment of the present invention.
Figure 3B:
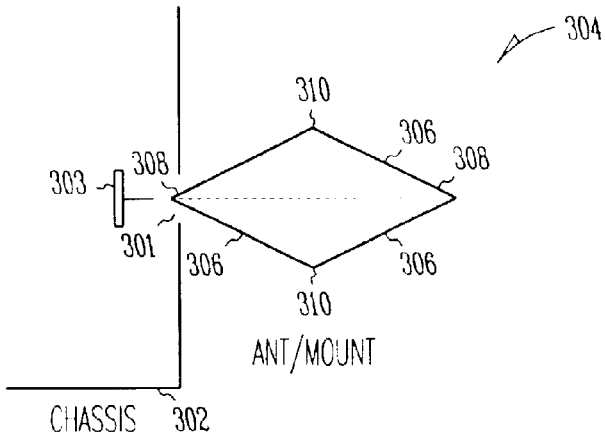
Figure 3C:
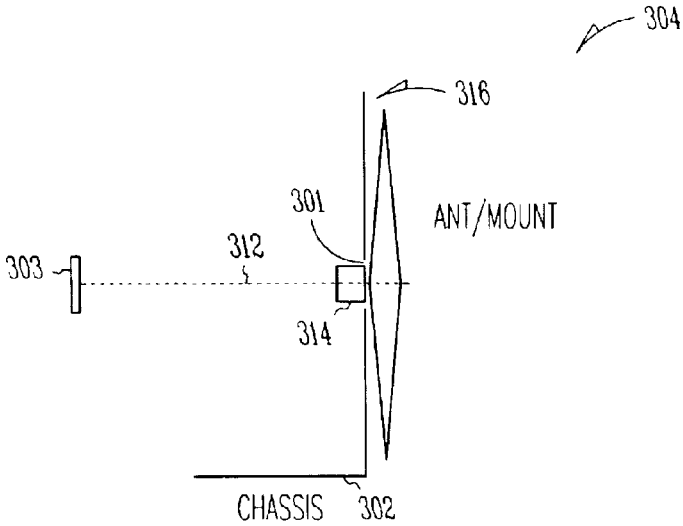

FIGS. 3A, 3B and 3C illustrate the installation of a collapsible antenna in accordance with an embodiment of the present invention. FIGS. 3A, 3B and 3C illustrate a side view of antenna 304 which may be suitable for use as antenna 104 (FIG. 1). In FIG. 3A, antenna 304 is illustrated in an initial folded position in which the antenna is internal to chassis 302. In FIG. 3B, antenna 304 is illustrated in an interim position in which that antenna has been pushed through hole 301 to provide the antenna in a position external to chassis 302 with a portion of axial element 312 remaining inside the chassis. In FIG. 3C, antenna 304 is illustrated in a final position in which axial element 312 has been retracted from the inside of chassis 302 to expand antenna 302 in a final position. Axial element 312 may be lock non-conductive element 306 in a final position. In one embodiment, clip 314 may be used to lock axial element 312 to inhibit antenna 304 from retracting and/or returning to the initial folded position. In one embodiment, clip 314 may provide mechanical support for an internal RF module, such as RF module 206 (FIG. 2), as well as the antenna elements providing mechanical stability to the antenna system.

In one embodiment, non-conductive element 306 may be long and wide and may be either substantially rectangular or oval shaped. Non-conductive element 306 may have folds 310 at center sides and may have opposite ends 308 coupled to axial element 312. In one embodiment, the non-conductive elements may have holes near ends 308 allowing axial element to pass through the holes. When antenna 304 is in the initial folded position (see FIG. 3A) opposite ends 308 of non-conductive element 306 may be furthest from each other on axial element 312. When antenna 304 is in a final position (see FIG. 3C), opposite ends 308 of non-conductive element 306 come into close proximity of each other or meet each other. In this embodiment, non-conductive element 306 may also have folds at ends 308.

In one embodiment, chassis 302 may be conductive and may provide a ground plane for antenna 304 when in the final position. In one embodiment, the conductive elements disposed on non-conductive element 306 may form a dipole antenna. In this embodiment, non-conductive element 306 may be approximately parallel to side 316 of chassis 302 when the antenna is in the final position.

Although antenna 302 is illustrated in FIGS. 3A, 3B and 3C as having a single non-conductive element 306 which, for example, may provide a single dipole, in other embodiments antenna 302 may have additional non-conductive elements which may support additional pairs of conductive elements. In one embodiment, the additional pairs of conductive elements may provide for additional dipoles, or in other embodiments, may provide for a cross dipole. The conductive elements may alternatively provide other types of antennas discussed above.

In one embodiment, base 303 of the antenna can be flanged with a clip that does not pass through the hole. The clip may provide mechanical stability. In one embodiment, the axial element may pass through the clip and provide force at the opposite end. In one embodiment, the axial element may be snapped off once the clip is in place. In one embodiment, the non-conductive element may be comprised of a flexible plastic which may be initially cylindrically shaped to transverse the mounting hole, and may be subsequently collapsed in an umbrella-like manner. In one embodiment, leads from a coaxial cable may be coupled directly to the conductive elements at the base. In some embodiments, the conductive elements of the antenna may be foil and may be folded in a planar inverted-F antenna (PIFA) configuration when in final position.

In some embodiments, an adhesive may be provided on the chassis side of non-conductive element 306 to allow the antenna to stick to the outside of chassis 302. A double-sided adhesive tape, or a double-sided foam may be used to stick non-conductive element 306 to chassis 302.

Figure 4:
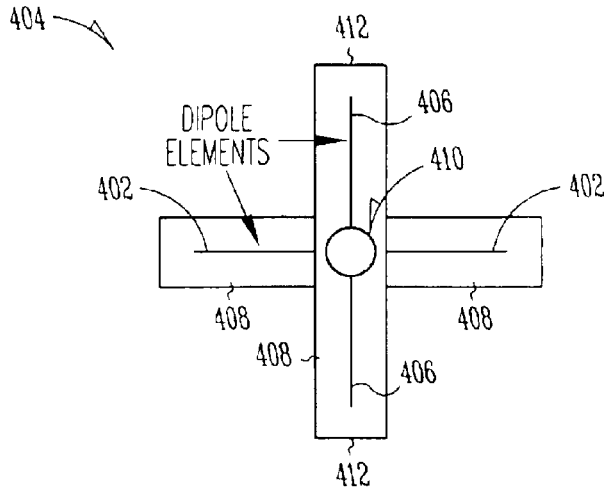
FIG. 4 illustrates a frontal view of a collapsible antenna in accordance with an embodiment of the present invention.

FIG. 4 illustrates a frontal view of a collapsible antenna in accordance with an embodiment of the present invention. Antenna 404 may be suitable for use as antenna 104 (FIG. 1), antenna 204 (FIG. 2), or antenna 304 (FIG. 3) although other antennas are also suitable. Antenna 404 may include conductive elements 402 and 406, which may be disposed on non-conductive elements 408. Antenna 404 may also include axial element 410, which may be perpendicular to the plane of the page in which antenna 404 is illustrated. Although antenna 404 is illustrated as either a cross-dipole antenna or two separate dipole antennas, in other embodiments of the present invention, antenna 404 may be comprised of a single dipole having only one set of conductive elements 402 and one non-conductive element 408.

In one embodiment, the conductive elements may form a cross dipole antenna comprised of conductive element pairs 402, 406 that are substantially orthogonally positioned when the antenna is in the final position. The conductive element pairs may receive RF receive signals and generate receive quadrature signals for RF circuitry (e.g., RF module 206 FIG. 2). In this embodiment, the conductive element pairs may transmit substantially circularly polarized RF transmit signals generated from transmit quadrature signals which may be provided by the RF circuitry.

In one embodiment, conductive elements 402, 406 may have a length selected for transmission of frequencies within one or more different frequency ranges. The lengths of the conductive elements may be selected (e.g., shortened) to compensate for effects of the ground plane provided by a conductive chassis. In a WLAN embodiment, one frequency range may be approximately 2.4 to 2.5 GHz and another frequency range is approximately 5.15 to 5.875 GHz, although other frequency ranges are equally suitable.

In a dual band embodiment, the conductive elements may form more than one dipole comprised respectively of conductive element pairs 402, 406 that are substantially orthogonally positioned when the antenna is in the final position. In this embodiment, one dipole may receive and/or transmit RF signals within one frequency range, and another dipole may receive and/or transmit RF signals within another frequency range. In this embodiment, the conductive elements of one dipole have a length selected for transmission of frequencies within one range, and the conductive elements of the other dipole may have a length selected for transmission of frequencies within the other frequency range. The lengths of the conductive elements may be shortened to compensate for effects of the ground plane provided by the chassis. In a WLAN embodiment, one frequency range may range from approximately 2.4 to 2.5 GHz and the other frequency range may range from approximately 5.15 to 5.875 GHz, although other frequency ranges are equally suitable. Other embodiments include multi-band embodiments and embodiments having more than one set of conductive elements disposed on one or more non-conductive structural elements to provide additional antennas.

In an ultra wideband (UWB) embodiment, the antenna may comprise a plurality of conductive elements having lengths selected for transmission and reception of frequencies over an ultra wide frequency range. A fractional bandwidth of the ultra wide frequency range may be greater than or equal to approximately twenty-five percent, and the fractional bandwidth may be approximately a 20 dB bandwidth divided by approximately a center frequency of the ultra wide frequency band.

One of non-conductive elements 408 may correspond with non-conductive element 306 (FIGS. 3A, 3B and 3C) and may be comprised of almost any non-conductive material. Examples of suitable materials include plastics, printed circuit board material. When a flexible non-conductive material is used, folds 310 (FIG. 3) and folds at ends 308 may be folds in the material. When a non-flexible non-conductive material is used for non-conductive elements 406, hinges may be used instead of folds to couple separate pieces of non-conductive material. Ends 412 illustrated in FIG. 4 may correspond with the location of folds 310 (FIG. 3).

Material used for conductive elements 402 and 406 may be almost any conductive material suitable for transmission/reception of RF signals. Examples of suitable conductive materials include aluminum, gold, copper, silver, brass, nickel and steel (and alloys thereof). The conductive material may be in the form of foil, wire, deposition, or plating, which may be disposed on the non-conductive element. The conductive elements may be connected to a receiver/transmitter element, such as RF module 206 (FIG. 2).

Figure 5A:
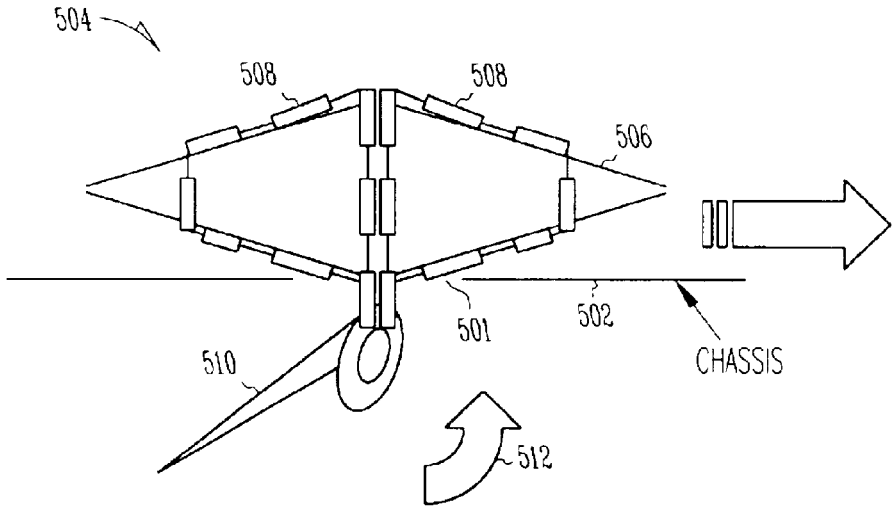
FIGS. 5A and 5B illustrate the operation of a clamping-wire antenna in accordance with an embodiment of the present invention.
Figure 5B:
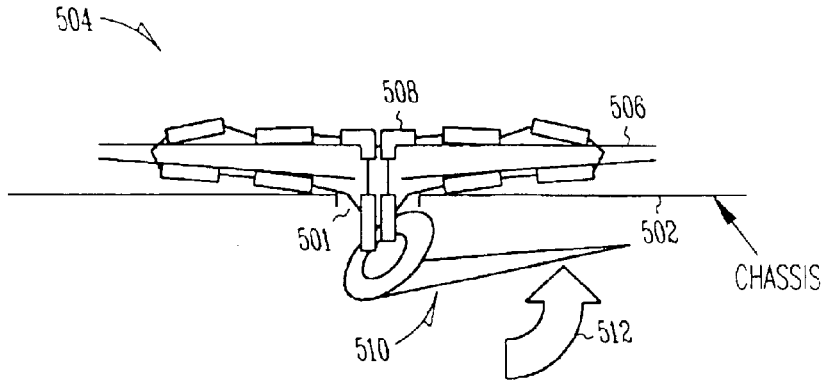

FIGS. 5A and 5B illustrate the operation of a clamping-wire antenna in accordance with an embodiment of the present invention. Clamping-wire antenna 504 may be suitable for use as antenna 104 (FIG. 1). Clamping-wire antenna 504 may be comprised of conductive elements 508, non-conductive element 506 and mechanical actuator 510. In accordance with this embodiment, clamping-wire antenna 504 may be transitioned to a final position external to chassis 502 by rotation/movement of mechanical actuator 510. In one embodiment, mechanical actuator 510 may be used to "pull" conductive elements 508 through hole 501 in chassis 502 as it is rotated in the direction 512.

In one embodiment, elements 508 serve as the conductive elements of the antenna for transmission/reception of RF signals. In an alternative embodiment, elements 508 may be non-conductive mechanical elements and used by actuator 510 to flatten non-conductive elements 506 into the final position. In this alternative embodiment, conductive elements for transmission and reception of RF signals may be disposed on non-conductive elements 506 to serve as the antenna's conductive elements. Antenna 504 may be suitable for communications in accordance with at least some of the communication techniques described above.

Figure 6A:
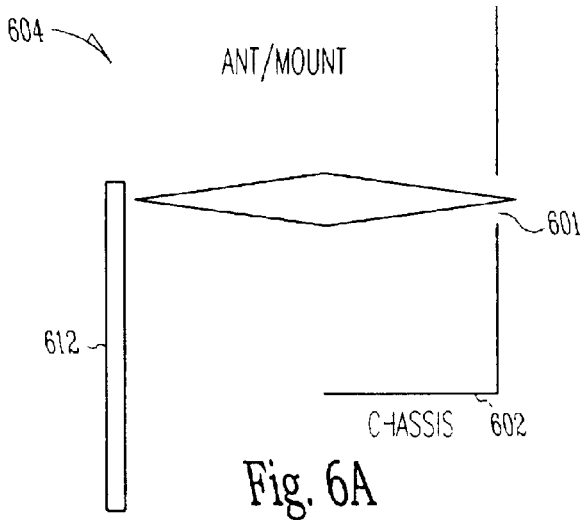
FIGS. 6A, 6B and 6C illustrate the installation of a collapsible antenna in accordance with another embodiment of the present invention.
Figure 6B:
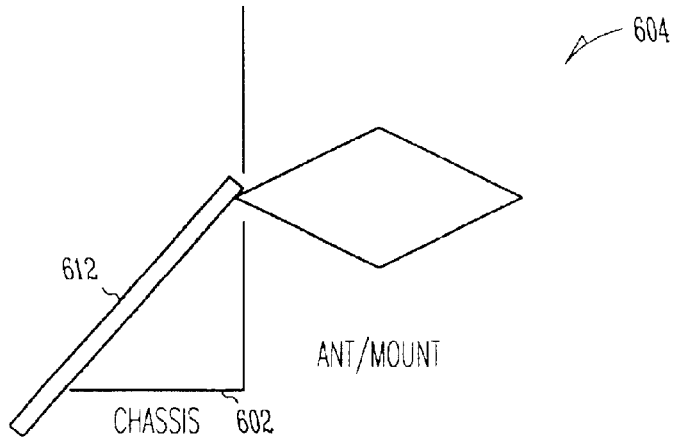
Figure 6C:
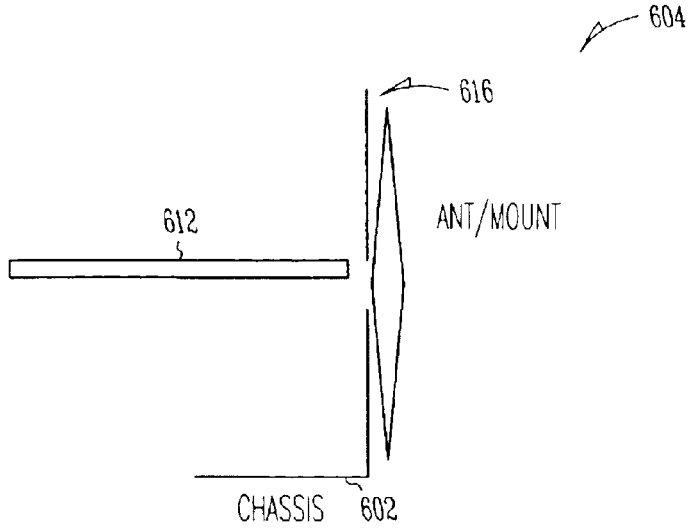

FIGS. 6A, 6B and 6C illustrate the installation of a collapsible antenna in accordance with another embodiment of the present invention. FIGS. 6A, 6B and 6C illustrate a side view of antenna 604. In FIG. 6A, antenna 604 is illustrated in an initial folded position in which the antenna is internal to chassis 602. In FIG. 6B, antenna 604 is illustrated in an interim position in which antenna 602 has been inserted through hole 601 in the chassis to provide the antenna in a position external to chassis 602. In FIG. 6C, antenna 604 is illustrated in a final position. Antenna 604 may be suitable for use as antenna 104 (FIG. 1) and/or antenna 204 (FIG. 2) and is similar to antenna 304 (FIG. 3) and axial element 312 may be replaced with lever arm 612.

In this embodiment, lever arm 612 may be moved to collapse the antenna and may function in combination with a retracting mechanism. In one embodiment, lever arm 612 may include, or may be comprised of, a printed circuit board (PCB) with RF elements, such as RF module 206 (FIG. 2), included thereon. Accordingly, data signals, via a data cable, may be provided directly to lever arm 612 eliminating any RF cabling. This embodiment may provide improved RF performance including improved signal to noise ratios. In one embodiment, a universal serial bus (USB) connection may be used to couple the RF module with other system elements. In another embodiment, peripheral component interconnect (PCI) express (PCIx) communication techniques may be used to couple the RF module with other system elements.

Although lever arm 612 is illustrated as being movable from a 90-degree position to a 180-degree position with respect to the antenna elements, in another embodiment, lever arm 612 may be configured to be movable from a 180-degree position to a 90-degree position depending on the specific implementation chosen and mechanical constraints within the chassis.

FIGS. 7A, 7B and 7C illustrate the installation of a collapsible antenna in accordance with another embodiment of the present invention. Antenna 704 may, for example, be suitable for use as antenna 104 (FIG. 1) and/or antenna 404 (FIG. 4), and may include any of the elements and features described above for communications including WLAN communications. In this embodiment, antenna 704 may be integrated into casing 703, and may be installed from a position external to chassis 702. Clip 714 may be integrated with an RF module on PCB 712, and may be aligned with connectors of antenna 704 for mating with the antenna. In this embodiment, clip 714 may provide a locking mechanism when PCB 712 and antenna 704 are mated in final position. The chassis, when conductive, may provide a ground plane for antenna 704. In one embodiment, a clip, such as clip 314, may provide mechanical support for the RF module and PCB 712 in addition to providing the antenna elements with mechanical stability.

Figure 8:
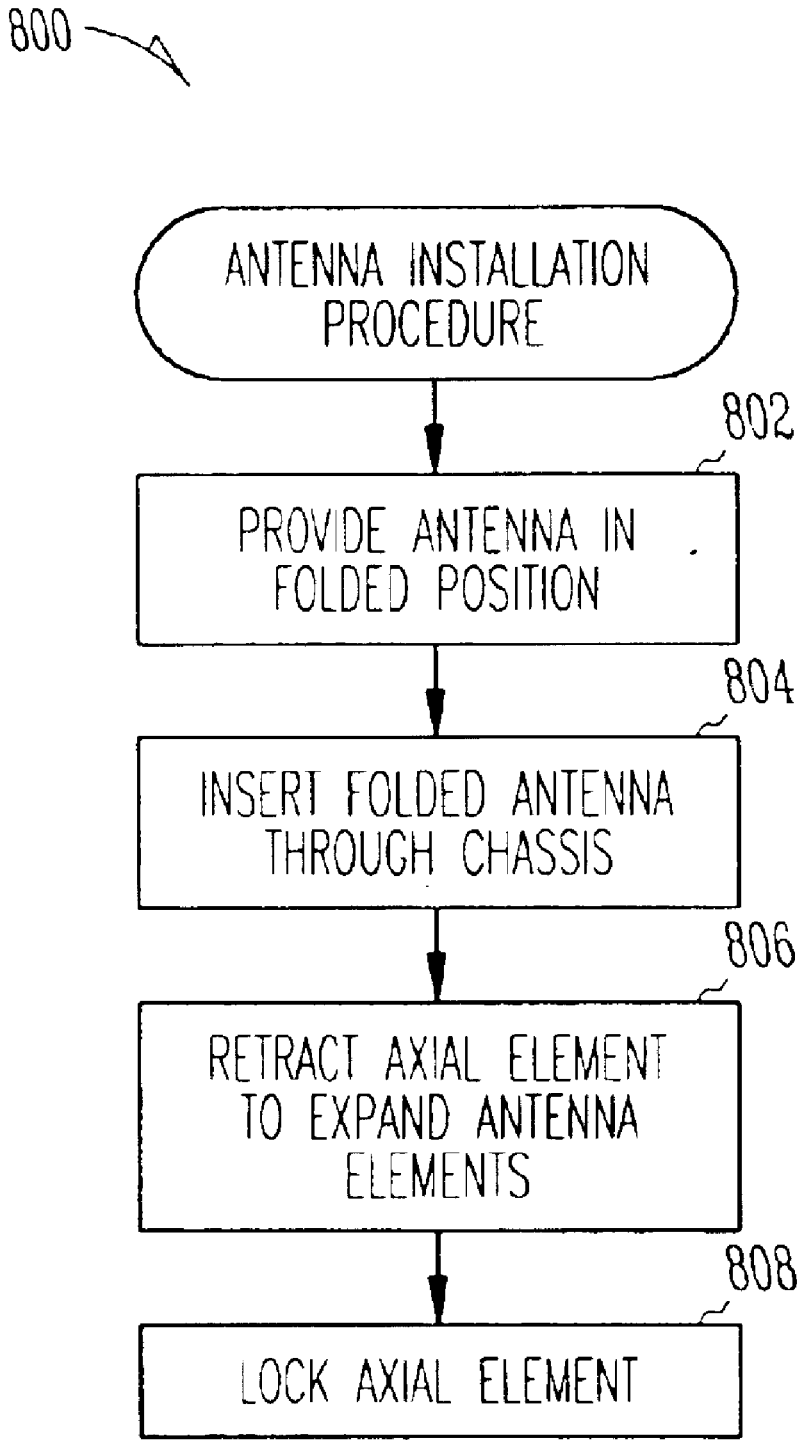
FIG. 8 is a flow chart of an antenna installation procedure in accordance with an embodiment of the present invention.

FIG. 8 is a flow chart of an antenna installation procedure in accordance with an embodiment of the present invention. In operation 802, a collapsible antenna is provided. The antenna may be similar to any one of the antennas previously described. The antenna may be provided internal to a chassis in an initial folded position (e.g., as illustrated in FIG. 3A). The conductive elements of the antenna may be provided connected to RF circuitry of the device. In operation 804, the conductive and non-conductive elements of the antenna are inserted through a hole in a chassis. The elements of the antenna may be inserted from the inside of the chassis. During this operation, the antenna may be in an initial folded position. In operation 806, an element, such as an axial element, may be retracted to expand the conductive and non-conductive elements of the antenna on an outside side of the chassis. In one embodiment, the non-conductive elements may have the conductors disposed thereon to form one or more dipoles. In operation 808, the axial element may be locked in position to inhibit the non-conductive element of the antenna from retracting. Operation 808 may include clipping or clamping the axial element, or the non-conductive and/or conductive elements in position with a clip or clamp, such as clip 314 (FIG. 3C). An example of this is illustrated in FIG. 3C. Upon the completion of operation 808, the antenna may be in a final position, and if the chassis is conductive, the chassis may provide a ground plane for the antenna. In one embodiment, an adhesive may be provided to adhere the non-conductive element to the chassis. Although the individual operations of procedure 800 are illustrated and described as separate operations, one or more of the individual operations may be performed concurrently and nothing requires that the operations be performed in the order illustrated.

Thus, an improved method and antenna for wireless network communications has been described. The foregoing description of specific embodiments reveals the general nature of the invention sufficiently that others can, by applying current knowledge, readily modify and/or adapt it for various applications without departing from the generic concept. Therefore such adaptations and modifications are within the meaning and range of equivalents of the disclosed embodiments. The phraseology or terminology employed herein is for the purpose of description and not of limitation. Accordingly, the invention embraces all such alternatives, modifications, equivalents and variations as fall within the spirit and scope of the appended claims.

What is claimed is:

1. An antenna for wireless local area network (WLAN) communications comprising:

conductive elements disposed on a non-conductive structural element; and an axial element coupled to the non-conductive element, the non-conductive element being approximately perpendicular to the axial element when the antenna is in a final position, the non-conductive element being approximately in-line with the axial element when the antenna is in an initial folded position, the axial element being in a retracted position inside a chassis when the antenna is in the final position, and the non-conductive element being substantially planar with a side of the chassis when the antenna is in the final position.

2. The antenna of claim 1 wherein the chassis is a conductive chassis of a wireless communication device, and wherein the final position is external to the conductive chassis, the initial position being internal to the chassis, and wherein the chassis has a hole therethrough to allow the antenna in the initial folded position to pass through.

3. The antenna of claim 1 wherein the conductive elements have a length selected for transmission of frequencies within a predetermined frequency range, the lengths of the conductive elements being selected to compensate for effects of a ground plane provided by a chassis.

4. The antenna of claim 1 wherein the conductive elements comprise a plurality of conductive elements having lengths selected for transmission and reception of frequencies over an ultra wide frequency range, wherein a fractional bandwidth of the ultra wide frequency range is greater than or equal to approximately twenty-five percent, the fractional bandwidth being approximately a 20 dB bandwidth divided by approximately a center frequency of the ultra wide frequency band.

5. An antenna for wireless local area network (WLAN) communications comprising:

conductive elements disposed on a non-conductive structural element; and an axial element coupled to the non-conductive element, the non-conductive element being approximately perpendicular to the axial element when the antenna is in a final position, the non-conductive element being approximately in-line with the axial element when the antenna is in an initial folded position, wherein the final position is external to a conductive chassis of a WLAN communication device, the initial position being internal to the chassis, and wherein the chassis has a hole therethrough to allow the antenna in the initial folded position to pass through, and wherein the antenna is pushed through the hole from an inside of the chassis when the antenna is in the initial folded position, the axial element is retracted from the inside of the chassis to expand the antenna to the final position on an outside side of the chassis, and the axial element is locked to inhibit the antenna from retracting to the initial folded position.

6. The antenna of claim 5 wherein the conductive chassis provides a ground plane for the antenna in the final position, the conductive elements form a dipole antenna, and the non-conductive element is approximately planar and approximately parallel to a side of the chassis having the hole when the antenna is in the final position.

7. The antenna of claim 5 wherein the axial element is threaded into threads of the non-conductive element and is rotated within the threads to expand the antenna into the final position external to the chassis after passing the non-conductive element through the hole.

8. The antenna of claim 5 wherein the non-conductive element is long and wide being either substantially rectangular or oval shaped, the non-conductive element having folds at side-centers and having opposite ends coupled to the axial element, wherein, when the antenna is in the initial folded position, the opposite ends of the non-conductive element are furthest from each other on the axial element, and when the antenna is in the final position, the opposite ends of the non-conductive element come into close proximity of each other.

9. The antenna of claim 5 wherein the non-conductive element has an adhesive disposed thereon to adhere the non-conductive element to a side of the chassis when in the final position.

10. The antenna of claim 5 wherein the axial element includes RF circuitry coupled directly to the conductive elements, the RF circuitry to convert RF signals received by the antenna to a digital form and to convert digital signals to RF signals for transmission by the antenna.

11. An antenna for wireless local area network (WLAN) communications comprising:

conductive elements disposed on a non-conductive structural element; and an axial element coupled to the non-conductive element, the non-conductive element being approximately perpendicular to the axial element when the antenna is in a final position, the non-conductive element being approximately in-line with the axial element when the antenna is in an initial folded position, wherein the conductive elements form a cross dipole comprised of first and second conductive element pairs that are substantially orthogonally positioned when the antenna is in the final position, the first and second conductive element pairs to receive RF receive signals and generate receive quadrature signals for RF circuitry, the first and second conductive element pairs to transmit substantially circularly polarized RF transmit signals generated from transmit quadrature signals provided by the RF circuitry.

12. An antenna for wireless local area network (WLAN) communications comprising:

conductive elements disposed on a non-conductive structural element; and an axial element coupled to the non-conductive element, the non-conductive element being approximately perpendicular to the axial element when the antenna is in a final position, the non-conductive element being approximately in-line with the axial element when the antenna is in an initial folded position, wherein the conductive elements form first and second dipoles comprised respectively of first and second conductive element pairs that are substantially orthogonally positioned when the antenna is in the final position, the first dipole to receive and transmit RF signals within a first frequency range, the second dipole to receive and transmit RF signals within a second frequency range.

13. The antenna of claim 12 wherein the conductive element pairs of the first dipole have a length selected for transmission of frequencies within the first frequency range, and the conductive pairs of the second dipole has a length selected for transmission of frequencies within the second range, the lengths of the conductive elements being selected to compensate for effects of the ground plane provided by the chassis, wherein the first frequency range is approximately 2.4 to 2.5 GHz and the second frequency range is approximately 5.15 to 5.875 GHz.

14. A device comprising:

a collapsible antenna;

a conductive chassis having a hole to allow the antenna to pass through in an initial folded position, the chassis to provide a ground plane for the antenna when the antenna is in a final position; and RF circuitry to communicate transmit and receive signals with the antenna, the antenna comprising a non-conductive structural element, conductive elements disposed on the non-conductive element, and an axial element coupled to the non-conductive element, the non-conductive element being approximately perpendicular to the axial element when the antenna is in the final position, the non-conductive element being approximately in-line with the axial element when the antenna is in the initial folded position, the axial element being in a retracted position inside the chassis when the antenna is in the final position, and the non-conductive element being substantially planar with a side of the chassis when the antenna is in the final position.

15. The device of claim 14 further comprising a plurality of conductive elements having lengths selected for transmission and reception of frequencies over an ultra wide frequency range, wherein a fractional bandwidth of the ultra wide frequency range is greater than or equal to approximately twenty-five percent, the fractional bandwidth being approximately a 20 dB bandwidth divided by approximately a center frequency of the ultra wide frequency band.

16. A device comprising:

a collapsible antenna;

a conductive chassis having a hole to allow the antenna to pass through in an initial folded position, the chassis to provide a around plane for the antenna when the antenna is in a final position; and RF circuitry to communicate RF transmit and receive signals with the antenna, the antenna comprising a non-conductive structural element, conductive elements disposed on the non-conductive element, and an axial element coupled to the non-conductive element, the non-conductive element being approximately perpendicular to the axial element when the antenna is in the final position, the non-conductive element being approximately in-line with the axial element when the antenna is in the initial folded position, wherein the antenna is pushed through the hole from an inside of the chassis when the antenna is in the initial folded position, the axial element is retracted from the inside of the chassis to expand the antenna to the final position on an outside side of the chassis, and the axial element is locked to inhibit the antenna from retracting to the initial folded position.

17. The device of claim 16 wherein the non-conductive element is long and wide being either substantially rectangular or oval shaped, the non-conductive element having folds at side centers and having opposite ends coupled to the axial element, wherein when the antenna is in the initial folded position, the opposite ends of the non-conductive element are furthest from each other on the axial element, and when the antenna is in the final position, the opposite ends of the non-conductive element come into close proximity of each other.

18. The device of claim 17 wherein the non-conductive element has an adhesive disposed thereon to adhere the non-conductive element to a side of the chassis when in the final position.

19. A device comprising:

a collapsible antenna;

a conductive chassis having a hole to allow the antenna to pass through in an initial folded position, the chassis to provide a around plane for the antenna when the antenna is in a final position; and RF circuitry to communicate RF transmit and receive signals with the antenna, the antenna comprising a non-conductive structural element, conductive elements disposed on the non-conductive element, and an axial element coupled to the non-conductive element, the non-conductive element being approximately perpendicular to the axial element when the antenna is in the final position, the non-conductive element being approximately in-line with the axial element when the antenna is in the initial folded position, wherein the conductive elements form first and second dipoles comprised respectively of first and second conductive element pairs that are substantially orthogonally positioned when the antenna is in the final position, the first dipole to receive and transmit RF signals within a first frequency range, the second dipole to receive and transmit RF signals within a second frequency range.

20. The device of claim 19 wherein the conductive elements of the first dipole have a length selected for transmission of frequencies within the first range, and the second dipole has a length selected for transmission of frequencies within the second range, the lengths of the conductive elements being selected to compensate for effects of the ground plane provided by the chassis.

21. The device of claim 20 wherein the first frequency range is approximately 2.4 to 2.5 GHz and the second frequency range is approximately 5.15 to 5.875 GHz.

22. A method comprising:

inserting an antenna through a hole in a conductive chassis from an inside of the chassis, the antenna being in an initial folded position;

retracting an axial element to expand a non-conductive element of the antenna on an outside side of the chassis, the non-conductive element having conductors disposed thereon to form a dipole; and locking the axial element to prevent the antenna from retracting.

23. The method of claim 22 wherein locking includes clamping the axial element.

24. The method of claim 22 wherein the axial element is threaded into threads of the non-conductive element, and wherein retracting includes rotating the axial element to expand the antenna into the final position external to the chassis after passing the non-conductive element through the hole.

25. The method of claim 22 wherein the non-conductive element is long and wide being either substantially rectangular or oval shaped, the non-conductive element having folds at side centers and having opposite ends coupled to the axial element, and wherein the non-conductive element has an adhesive disposed thereon, the method further comprising pressing the non-conductive element against the chassis to adhere the non-conductive element to a side of the chassis to position the antenna in the final position.

26. The method of claim 25 wherein when the antenna is in the initial folded position, the opposite ends of the non-conductive element are furthest from each other on the axial element, and when the antenna is in the final position, the opposite ends of the non-conductive element come into close proximity of each other.

27. The method of claim 25 wherein the conductive elements provide a dipole and have a length selected for transmission of frequencies within either a first or second frequency range, the lengths of the conductive elements being selected to compensate for effects of the ground plane provided by the chassis.

28. A clamping wire antenna comprising:

a non-conductive element;

conductive elements to provide elements of a dipole; and a rotatable mechanical actuator to pull the conductive elements through a hole in a chassis of a communication device to expand the conductive elements on an outside of the chassis and lock the conductive elements in a final position to inhibit the conductive elements from retracting.

29. The antenna of claim 28 wherein conductive elements and non-conductive element are pushed through the hole from an inside of the chassis when the antenna is in the initial folded position.

30. The antenna of claim 28 wherein the chassis is conductive and provides a ground plane for the antenna in the final position, the conductive elements of the antenna forming a dipole, and the non-conductive element is approximately planar and approximately parallel to a side of the chassis having the hole when the antenna is in the final position.

* * * * *